US006239764B1

(12) United States Patent
Timofeev et al.

(10) Patent No.: US 6,239,764 B1
(45) Date of Patent: May 29, 2001

(54) WIDEBAND MICROSTRIP DIPOLE ANTENNA ARRAY AND METHOD FOR FORMING SUCH ARRAY

(75) Inventors: Igor E. Timofeev, Suwon-shi; Je-Woo Kim, Songnam-shi; Kyung-Sup Han, Suwon-shi, all of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/328,374

(22) Filed: Jun. 9, 1999

(30) Foreign Application Priority Data

Jun. 9, 1998 (KR) ..... 98-21305

(51) Int. Cl.[7] ..... H01Q 1/38

(52) U.S. Cl. ..... 343/795; 343/700 MS; 343/810

(58) Field of Search ..... 343/700 MS, 795, 343/793, 810, 812, 813, 815, 816, 817, 818, 819; H01Q 1/38

(56) References Cited

U.S. PATENT DOCUMENTS

| | | | |
|---|---|---|---|
| 3,587,105 | 6/1971 | Neilson . | |
| 3,681,769 | 8/1972 | Perrotti et al. . | |
| 3,681,771 | 8/1972 | Lewis et al. . | |
| 4,360,816 | 11/1982 | Corzine . | |
| 4,471,493 | 9/1984 | Schober . | |
| 4,590,614 | 5/1986 | Erat et al. . | |
| 4,623,894 * | 11/1986 | Lee et al. | 343/700 MS |
| 5,061,944 * | 10/1991 | Powers et al. | 343/795 |
| 5,313,218 | 5/1994 | Busking et al. . | |
| 5,495,260 | 2/1996 | Couture et al. . | |
| 5,686,928 | 11/1997 | Pritchett et al. . | |
| 5,828,342 | 10/1998 | Hayes et al. . | |
| 6,023,243 * | 2/2000 | Frank | 343/795 |

OTHER PUBLICATIONS

1.R.J. Mailoux, Phased Array Antenna Handbook, Artech House, 1994 Fig. 5.28 A, Chapter 5.1.2 and Chapter 6, including pp. 240–267, 310, 311 and 322–391.

2.The Ultimate Decay of Mutual Coupling In A Planar Array Antenna by P.W. Hannan, IEEE Trans., v. AP–14, Mar. 1966, pp. 246–248.

3.Antenna Engineering Handbook by R.C. Johnson, 3rd ed., McGraw Hill,, NY, 1993, pp. 20–24 through 20–31 and pp. 32–20 through 32–23.

* cited by examiner

*Primary Examiner*—Hoanganh Le
(74) *Attorney, Agent, or Firm*—Robert E. Bushnell, Esq.

(57) ABSTRACT

A microstrip dipole antenna array is provided. In the microstrip dipole antenna array, a number N of printed circuit boards (PCBs) are equally spaced in parallel to one another and each printed circuit board (PCB) has a microstrip dipole and a microstrip feed. The printed circuit boards (PCBs) are symmetrically located between a number (N+1) of metal fences in parallel to the metal fences.

39 Claims, 6 Drawing Sheets

WIDEBAND MICROSTRIP DIPOLE ANTENNA ARRAY AND METHOD FOR FORMING SUCH ARRAY

CLAIM OF PRIORITY

This application makes reference to, incorporates the same herein, and claims all benefits accruing under 35 U.S.C. §119 from an application entitled WIDEBAND MICROSTRIP DIPOLE ANTENNA ARRAY earlier filed in the Korean Industrial Property Office on Jun. 9, 1998, and there duly assigned Serial No. 98-21305.

BACKGROUND OF THE INVENTION

1. Field of the Invention

The present invention relates to an antenna, and in particular, to a printed-dipole antenna array and a method for forming a printed-dipole array antenna.

2. Description of the Related Art

In general, a printed-dipole antenna array is utilized in wideband communication systems (e.g., point-to-point, radio relay, cellular, PCS: Personal Communication Service, and satellite communications), radars, and electromagnetic support measurement (ESM) and electromagnetic counter measurement (ECM) systems.

The printed array antenna technology enables a light-weight and low-cost antenna structure to be achieved. One of the most popular elements in printed arrays is the microstrip dipole using a wide frequency range from ultra high frequency (UHF) to $K_a$ band (see R. J. Mailloux, *Phased Array Antenna Handbook,* Artech House, 1994, p.251). At pages 310 and 311 of the above-mentioned Phased Array Antenna Handbook is described a conventional microstrip dipole array, fully available with low-cost fabrication. Microstrip dipoles and a microstrip corporate feed having phase shifters and other integrated devices are etched together on the same printed circuit board (PCB). In *Antenna Engineering Handbook* by R. C. Johnson, 3rd edition, McGraw Hill, NY, 1993 (pp. 32–22 and 20–29), two other samples of printed-dipole array antennas with a similar architecture are described.

FIG. 1 is a schematic perspective view of a conventional printed-dipole antenna array (see *Phased Array Antenna Handbook,* FIG. 5.28A). In FIG. 1, printed circuit boards (PCBs) 10 each having microstrip dipoles 12 and a feed 14 are installed parallel to each other and perpendicular to a common flat ground screen 18 providing the antenna array structure. The feed 14 includes integrated devices 16 such as amplifiers and phase shifters. The common flat ground screen 18 functions to eliminate back radiation of the antenna array and separates a dipole area from a feed area. A low sidelobe level over a relatively wide bandwidth (15–20%) can be achieved by this type of antenna array, as the number of elements is large (see, *Low Sidelobe Phased Array Antennas* by H. E. Schrank, IEEE APS Newsletter, 25, pp. 5–9). In this way these printed dipole array antennas are widely used in many applications.

However, there are various technical problems of the conventional dipole array that can occur.

A first problem is that a big wind-loaded area can be present from a face direction. This is caused by a solid ground screen. In order to reduce the wind-loaded area, special radomes are typically used, generally increasing the cost of an antenna system.

A second problem is that bandwidth and wide-angle scan limitations can exist due to a mutual coupling phenomena.

The mutual coupling is one of the main factors which limit a wideband antenna array operation. In the H-plane the mutual coupling is proportional to $1/\gamma$ and in the E-plane to $1/\gamma^2$ wherein $\gamma$ is the distance between dipoles. The mutual coupling in the H-plane is more significant than in the E-plane (see, *The Ultimate Decay of Mutual Coupling in a Planar Array Antenna* by P. W. Hannan, IEEE Trans., v. AP-14, March 1966, pp. 246–248). In this regard, it is very important to decrease mutual coupling in the H-plane. The mutual coupling can produce an impedance mismatch in a scan area, can reduce a bandwidth and scan angles, and in the case of a relatively small array, can increase sidelobes (see, Phased Array Antenna Handbook, Chapter 6).

A third problem is that the element pattern of a dipole in the array is far from an ideal "top-flat" element pattern with a constant level at a scan angle and a zero level at other angles. In the top-flat element pattern, scan losses are minimized and grating lobes are suppressed. Use of top-flat radiators, for instance, sharp dielectric bars, typically allows a dramatic reduction in the number of elements and the cost of a phased array. Further, the top-flat element pattern is very useful in a fixed-beam antenna array, because of suppression of far sidelobes.

A fourth problem is that quite different parameters can be present in the edge dipoles from those in central dipoles (see *Phased Antenna Handbook,* p.330). The parameters can include element pattern, impedance, and polarization properties. This edge phenomenon can result in the increase of back lobe and sidelobe, especially in a small array, such as where the number of elements is from 4 to 100.

Lastly, a fifth problem is that in the case of an active array, a ground screen can hinder effective cooling of an active device like a high power amplifier due to poor ventilation.

U.S. Pat. No. 3,587,105 to Neilson entitled Picture Framed Antenna, discloses a folded dipole antenna is provided by means of three circuit boards disposed in three hinged picture frames forming a horizontal array in which the antenna pattern on the circuit boards is made electrically continuous through connections in the hinges of the picture frames.

U.S. Pat. No. 3,681,769 to Perrotti et al. entitled Dual Polarized Printed Circuit Dipole Antenna Array, disclose an antenna array is provided by stacking two PC boards in a superimposed relationship above a housing acting as a ground plane. Each of these two PC boards contain thereon a symmetrical arrangement of photo etched or printed mat-strip power division networks and dipole elements providing linear polarization, the dipole elements on one PC board being oriented with the dipole elements on the other PC board to provide orthogonal linear polarizations. A ground plane for the dipole elements on the upper PC board is provided by parallel, spaced conductive members in a superimposed, parallel relationship with the dipole elements of the upper PC board. In one embodiment, the ground plane conductive members are provided by conductive strips on a third PC board disposed between the first two PC boards. In another embodiment, the same third PC board is disposed between the lower PC board and the housing ground plane therefore. In a third embodiment, the ground plane conducive members are formed as ridges on the housing ground plane.

U.S. Pat. No. 3,681,771 to Lewis et al. entitled Retroflector Dipole Antenna Array And Method of Making, disclose a method of making an antenna array and an antenna array apparatus of a wide angle retroreflector is provided in which a printed circuit board has a plurality of antenna elements etched on one side thereof and a ground plane on the other separated by dielectric material of a predetermined thickness. Baluns are disclosed as being attached through the printed circuit board to each antenna element and to the ground plane and transmission lines of equal length connect spaced pairs of antenna elements utilizing the balun and matching the transmission line to the antenna element.

U.S. Pat. No. 4,360,816 to Corzine entitled Phased Array of Six Log-periodic Dipoles, discloses a direction finding antenna for actuated direction finding over broad conuous frequency spectrums, independently of polarization, including a phased array of six log-periodic dipole antennas with loaded elements.

U.S. Pat. No. 4,471,493 to Schober entitled Wireless Telephone Extension Unit With Self-Contained Dipole Antenna, discloses a remote unit for use in a wireless extension telephone system having a self-contained dipole antenna. Utilizing the construction of the telephone instrument housing one element of the dipole is included in a planar element that functions normally to direct sound to a self-contained microphone and the other element of the antenna is a static shield used to protect components a printed circuit board included within the extension unit.

U.S. Pat. No. 4,590,614 to Erat entitled Dipole Antenna For Portable Radio, discloses a dipole antenna for a portable radio is contained completely within the insulated housing of the transceiver. The dipole antenna is formed as two conductive surfaces electrically isolated from each other but disposed on the same printed circuit board of the transceiver circuit which supports the circuit modules. The two dipole halves are connected to each other by means of a dipole tuning circuit. The conductive tracks of the transceiver circuit are interrupted at a location which divides as few tracks as possible. The interrupted tracks are bridged together by high-impedance resistors.

U.S. Pat. No. 5,313,218 to Busking entitled Antenna Assembly, discloses an antenna assembly that includes a dipole antenna and a monopole antenna having substantially perpendicular polarization directions. The dipole antenna is provided with a balun a portion of which serves as a backplane for a microstrip transmission line which transmits RF signals. The microstrip transmission line includes a first portion connected to a coaxial feed cable, a second portion having its ends respectively connected by a first switch to the monopole antenna and a second switch to the balun portion and third portion when the switches are closed to render the monopole antenna operative, the third portion serves to detune the dipole antenna. The assembly it is disclosed can be formed as a two-sided printed circuit board.

U.S. Pat. No. 5,495,260 to Couture entitled Printed Circuit Dipole Antenna, discloses a paging receiver including a printed circuit board on which receiving circuitry is mounted. The printed circuit board includes a plurality of conductive runners which form a dipole antenna for providing radio frequency signals to the receiving circuitry. First and second elongated runners are disclosed as being plated on a first surface of the printed circuit board along a single axis. Third and fourth elongated runners are plated on a second surface of the printed circuit board parallel to and beneath the first and second elongated runners, respectively. The first and third runners are electrically coupled via a first plated hole from a first monopole element of the dipole antenna for providing the signals to the receiving circuitry, and the second and fourth runners are electrically coupled via a second plated hole to from a second monopole element of the dipole antenna.

U.S. Pat. No. 5,686,928 to Pritchett et al. entitled Phased Array Antenna For Radio Frequency Identification, disclose a multi-element, H plane, phased, dipole array antenna, wherein two printed wiring boards feed and physically support the dipole antenna elements. The phase and spacing of the dipole elements establish the radiation elevation angle, and a planar metallic reflector, spaced on the order of a half wavelength of the RF signal from the dipole array, interacts with the dipole-element pattern, to provide wide angle azimuth gain.

U.S. Pat. No. 5,828,342 to Hayes et al. entitled Multiple Band Printed Monopole Antenna, disclose a printed monopole antenna including a first printed circuit board having a first side and a second side, a first monopole radiating element in the form of a conductive trace formed on a side of the first printed circuit board, and a second monopole radiating element in the form of a conductive trace positioned adjacent the first monopole radiating element, wherein the first monopole radiating element is resonant within a first frequency band and the second monopole radiating element is resonant within a second frequency band. In order for the first and second radiating elements to be resonant within different frequency bands, the conductive traces for each are disclosed to have different electrical lengths. No direct electrical connection is disclosed to exist between the monopole radiating elements, but the second radiating element dominates at a frequency in which the second radiating element is approximately a half-wavelength so that coupling with the first radiating element occurs. The first and second monopole radiating elements are formed on the same side of the first printed circuit board, separate sides of the first printed circuit board, or on separate printed circuit boards.

SUMMARY OF THE INVENTION

An object of the present invention, therefore, is to provide a wideband microstrip dipole antenna array which can overcome the problems of a large wind-loaded area, significant mutual coupling between dipoles, a poor element pattern, edge phenomenon, and poor ventilation.

To achieve the above object and other objects of the present invention, there is provided a microstrip dipole antenna array. In the microstrip dipole antenna array, a number N of printed circuit board (PCBs) are equally spaced in parallel to one another and each printed circuit board (PCB) has a microstrip dipole and a microstrip feed. The printed circuit board (PCBs) are symmetrically located between a number (N+1) of metal fences in parallel to the metal fences.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 2:
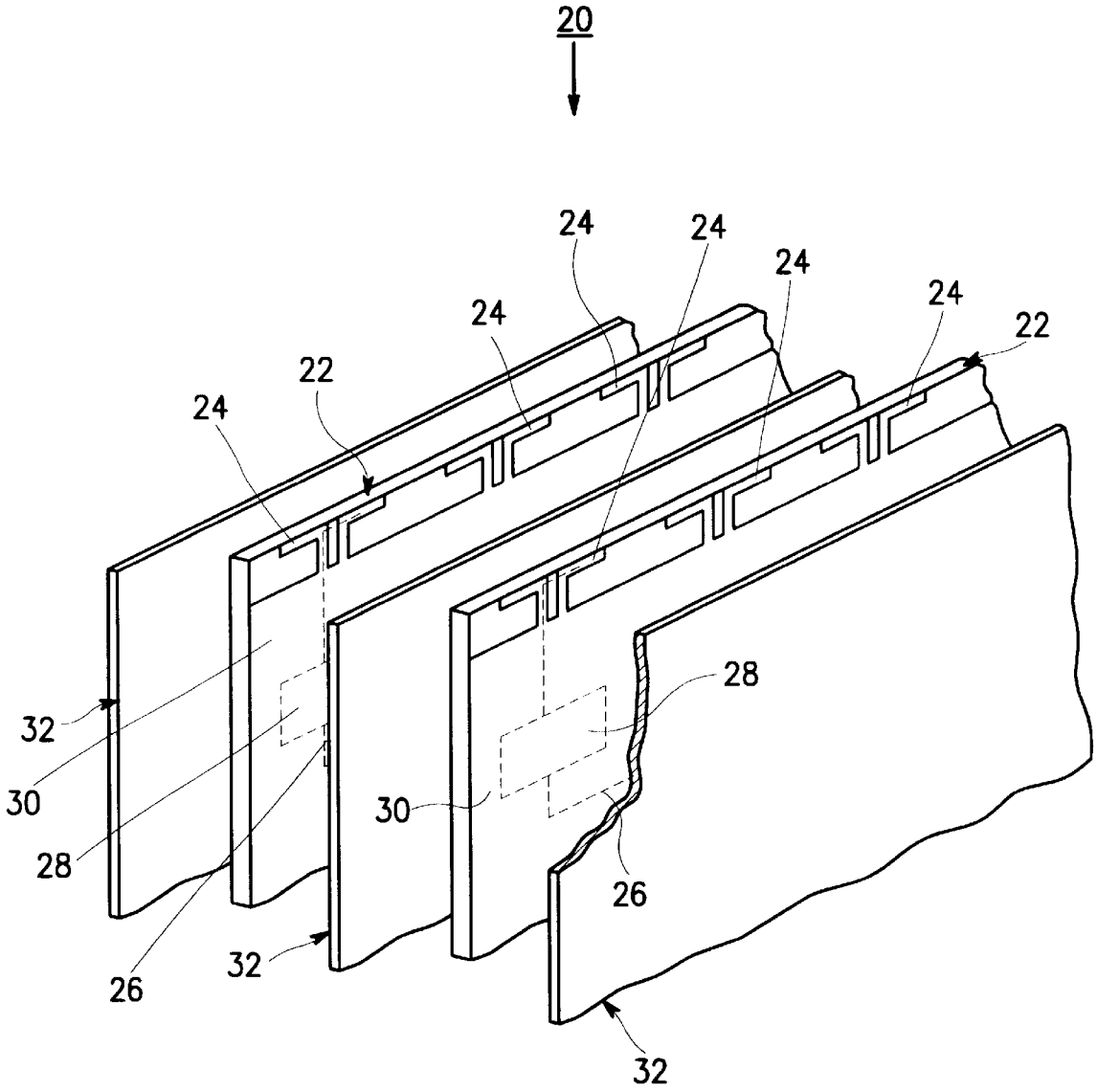
FIG. 2 is a schematic view of a wideband microstrip dipole antenna array according to an embodiment of the present invention.

Referring to FIG. 2, FIG. 2 illustrates a wideband microstrip dipole antenna array according to an embodiment of the present invention. In FIG. 2, an antenna array 20 is a periodic structure in which printed circuit boards (PCBs) 22 alternate with thin metal fences 32. Each printed circuit board (PCB) 22 has microstrip dipoles 24, a microstrip feed 26, and integrated devices 28. Each metal fence 32 is disposed between printed circuit boards (PCBs) 22 in parallel to the printed circuit boards (PCBs), with a metal fence disposed in parallel to each opposing side of a printed circuit board (PCB) 22, as illustrated in FIG. 2. Therefore, given the number of the printed circuit boards (PCBs) 22 as N, the number of the metal fences 32 is (N+1) in antenna array 20, with N being a positive integer. For example, FIG. 2 illustrates two printed circuit boards 22 and three metal fences 32.

Figure 3:
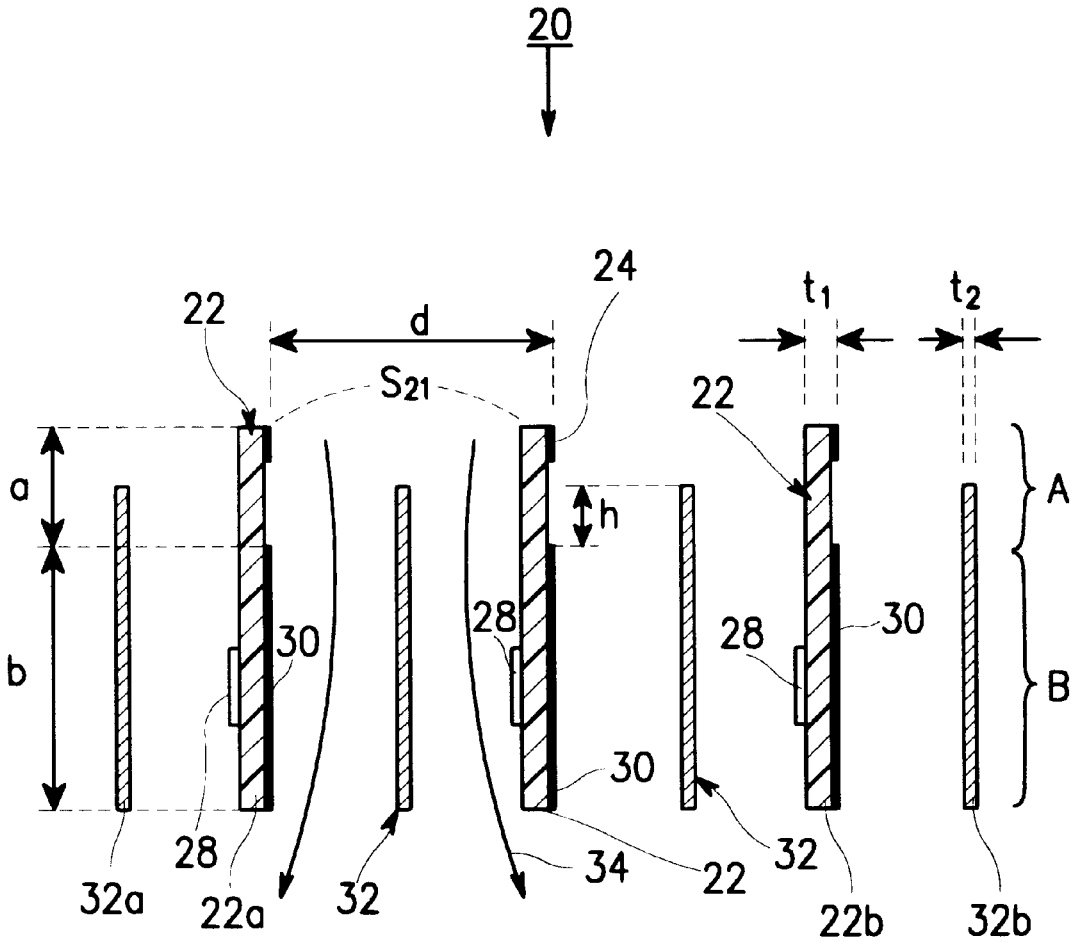
FIG. 3 is a sectional view of the microstrip dipole antenna array shown in FIG. 2.

FIG. 3 is a sectional view of the antenna array 20 shown in FIG. 2, with the feeds 26 omitted for clarity. In FIG. 3, reference character A indicates a metal plate-absent area, and reference character B indicates a metal plate-present area. Other reference characters a, b, d, h, $t_1$, and $t_2$ indicate the sizes of their corresponding parts. As shown in FIG. 3, the height of the printed circuit boards (PCBs) 22 is a+b, where a and b are the heights of a dipole area and a feed area, respectively. The reference character d is the distance between adjacent printed circuit board (PCBs) 22, $t_1$ is the thickness of each printed circuit boards (PCB) 22, and $t_2$ is the thickness of each metal fence 32, 32*a* and 32*b*. The height of the metal fences 32, 32*a* and 32*b* is b+h, where h can vary in height from 0 to a. The choice of sizes a and d is based on the same deign principles as for a conventional dipole array antenna, as follows:

$$a=0.15-0.3\lambda \quad \text{(Equation 1a), and}$$

$$d=k\lambda(1+|\sin\beta_0|) \quad \text{(Equation 1b)}$$

where $\lambda$ is the wavelength in a free space, $\beta_0$ is a maximal scan angle, k is a coefficient dependent on the array size, ranging from 0.7 to 0.9, for example.

Figure 1:
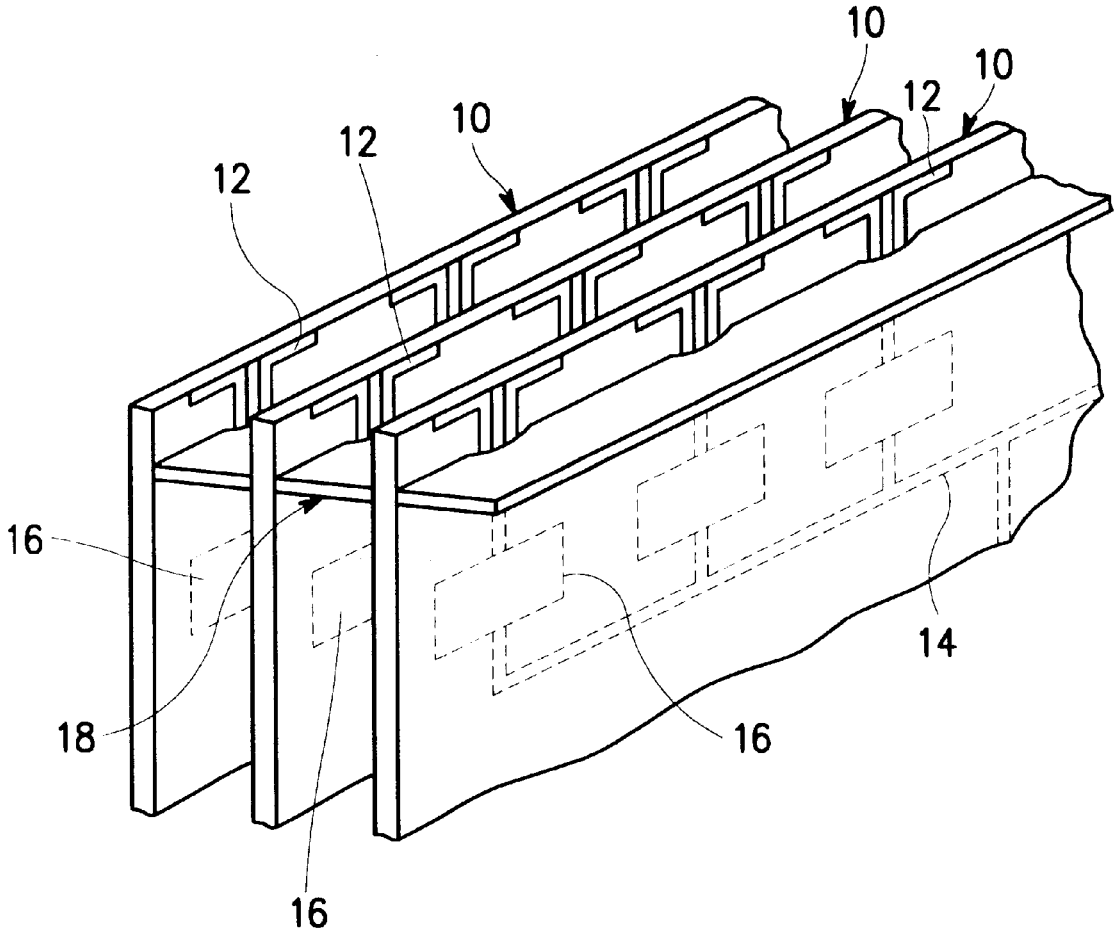
(PRIOR ART) FIG. 1
FIG. 1 is a schematic view of a conventional microstrip dipole antenna array.

The antenna array 20 shown in FIGS. 2 and 3 according to the present invention will be considered from the mechanical point of view. As shown in FIG. 3, an air flow 34 indicated by arrowed lines can easily penetrate through the antenna array 20 and thus the wind-loaded area of the antenna array is far less than that of the conventional antenna array shown in FIG. 1. The reduction of the wind-loaded area can be approximately determined as follows:

$$S_a/S_b=dN/[Nt_1+(N+1)t_2] \quad \text{(Equation 2)}$$

where $S_a$ and $S_b$ are the wind-loaded areas of the prior art dipole antenna array of FIG. 1 and the dipole antenna array of FIGS. 2 and 3, for example, of the present invention, respectively, and the other parameters d, $t_1$ and $t_2$ are as previously discussed with reference to FIG. 3 and are as shown in FIG. 3, with N being the number of printed circuit boards and (N+1 ) being the number of metal fences. The wind-loaded area can be reduced by 10 to 100 times because $t_1$, $t_2$<<d. The air flow 34 produces a heat transfer from the active integrated devices 28, providing more effective cooling in comparison with the prior art dipole antenna array of FIG. 1, for example.

Considering now the antenna array 20 from the electrical point of view referring to FIGS. 2 and 3, and the previous discussion, the metal fences 32 operate in different ways in the areas A and B. In the area A, the metal fences 32 provide impedance matching and form an array element pattern, while in the area B, the metal fences 32 eliminate back radiation. The metal fences 32 add another dimension to the antenna array 20 to optimize the impedance match of the dipoles 24 and improve a wide scan angle match by varying the size h, in the area A. This is achieved by reducing the mutual coupling between the dipoles 24 in the H-plane with use of the metal fences 32.

Figure 4:
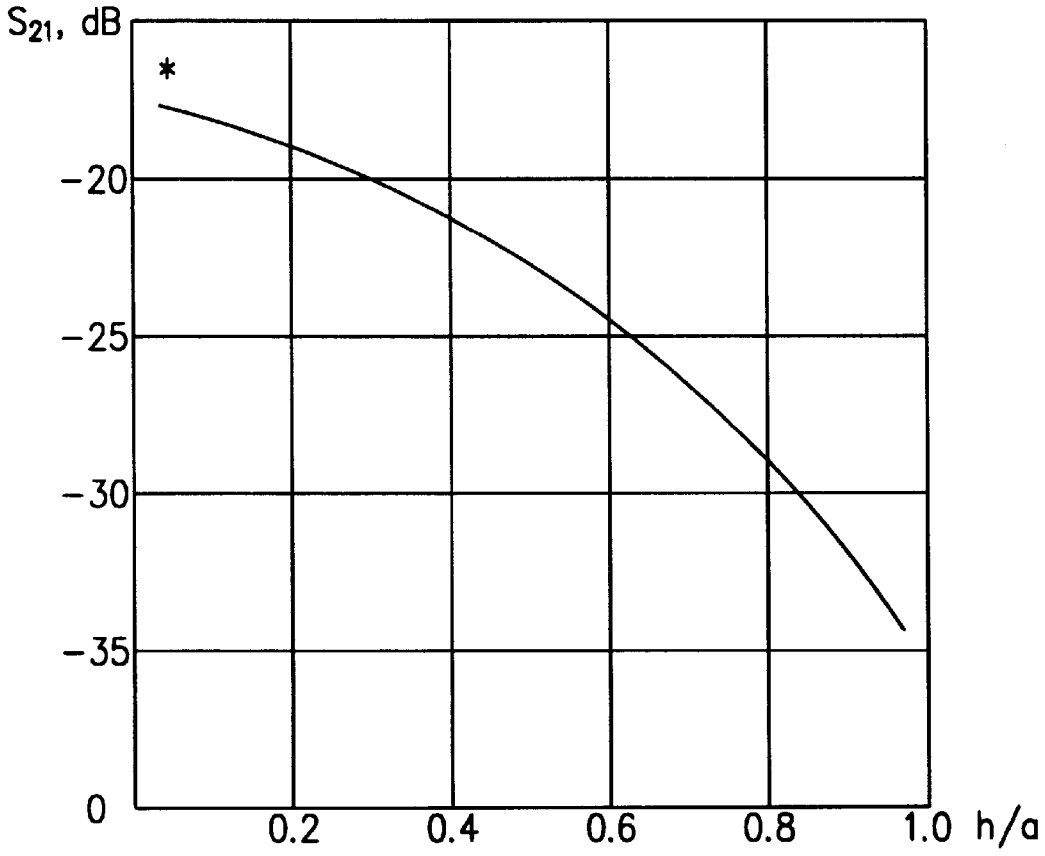
FIG. 4 is a graph showing the dependence of measured mutual coupling coefficients on the distance between a dipole and a metal fence.

Continuing with reference to FIG. 4, the measured dependence of a mutual coupling coefficient upon the size h is shown in FIG. 4, with FIG. 4 showing the dependence measured mutual coupling coefficients on the distance between a dipole 24 and a metal fence 32. In FIG. 4, with reference to FIG. 3, mutual coupling coefficients are measured with respect to h/a and $S_{21}$ is a mutual coupling coefficient in decibels (dB). FIG. 4 shows that the metal fences 32 reduce the mutual coupling coefficients by 10 to 15 dB. Thus, the impedance of the dipoles 24 virtually does not change during scanning in the H-plane, thereby enabling a wider band and wider angle operation.

Figure 5:
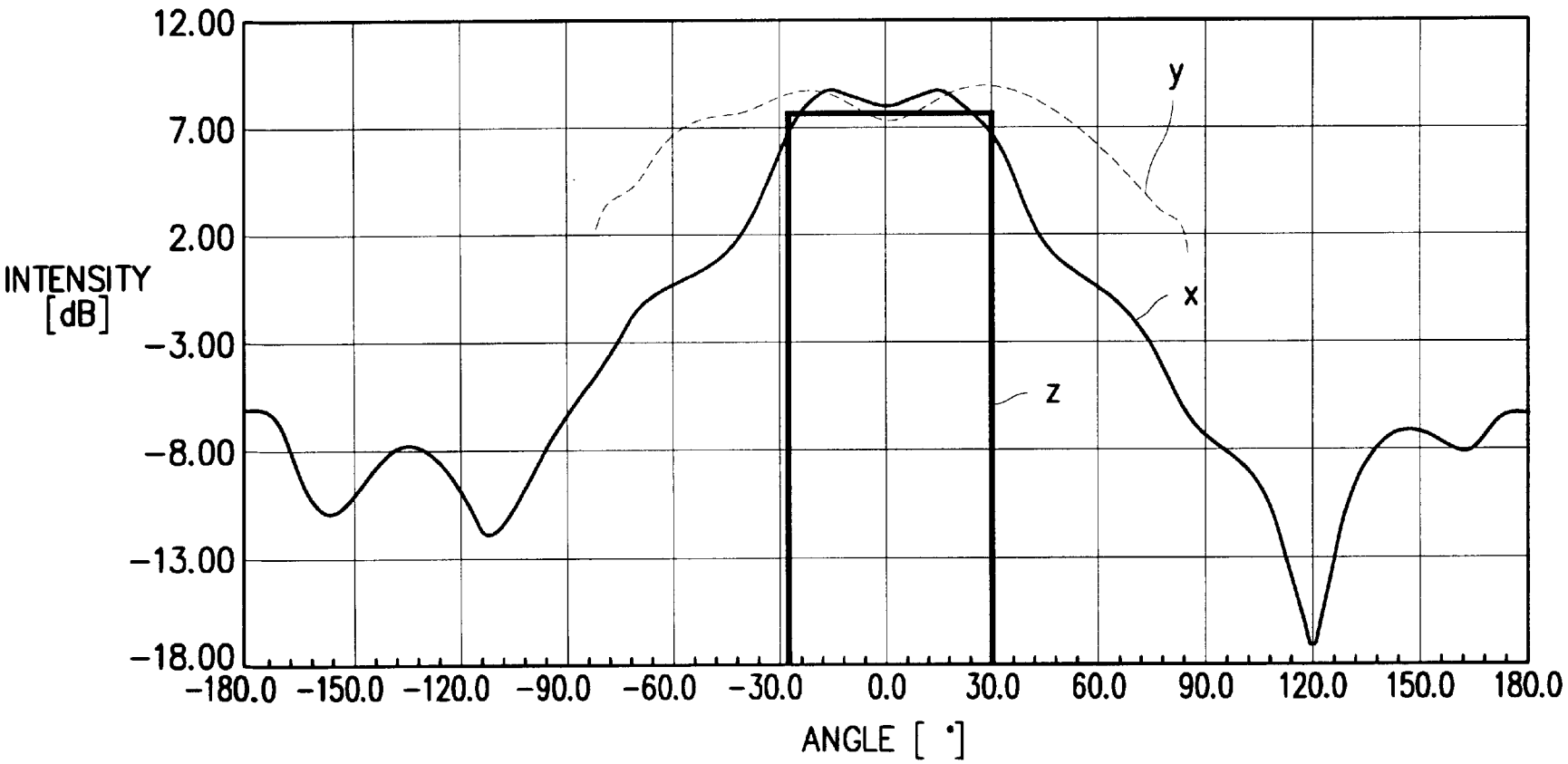
FIG. 5 is a graph showing a measured element pattern in the H-plane of an antenna array according to an embodiment of the present invention.

Referring to FIGS. 2 to 5, the metal fences 32 help to optimize an array element pattern by varying the size h. Due to the significant suppression of mutual coupling by the metal fences 32, the element pattern in the H-plane is mostly dependent on two adjacent metal fences 32 and the top-flat element pattern can be obtained by choice of the sizes h, d, and a, with FIG. 5 showing a measured element pattern in the H-plane of an antenna array according to the present invention of FIGS. 2 and 3, for example. In FIG. 5, a measured element pattern indicated by curve x of antenna array 20 of FIGS. 2 and 3 is flat in a scan sector in a range in degrees (°) of ±30°, and sharply drops outside the scan sector. The flat element pattern illustrated by the curve x of FIG. 5 provides a constant array gain at the scan angles, and the dropping element pattern decreases sidelobe and grating lobe outside the scan sector. This increases the distance din the antenna array 20 and, as a consequence, reduces the number N of the printed circuit boards (PCBs) 22. Therefore, the overall cost of the antenna is reduced in comparison with the conventional technology. The conventional element pattern is also shown as curve y in FIG. 5, for comparison. From FIG. 5, it is noted that the conventional element pattern of curve y is far from the ideal top-flat element pattern of curve z of FIG. 5 and the optimized element pattern of the antenna array 20 of curve x is close to the ideal one.

Continuing with reference to FIG. 3, in FIG. 3, edge metal fences 32*a* and 32*b* prevent current leakage of printed circuit boards (PCBs) 22*a* and 22*b* to metal plates 30, thereby reducing back radiation. This is because, as described before, the major factor affecting the H-plane pattern of the dipoles 24 in the antenna array 20 is the influence of two adjacent metal fences 32, the pattern of all elements, central and edge, in the antenna array 20 is almost the same, and the edge phenomenon is weaker than in the conventional antenna array of FIG. 1.

Again referring to FIG. 3, in the area B, the metal fences 32 and the metal plates 30 of the printed circuit boards (PCBs) 22 form a system of parallel plate cutoff waveguides. The distance between the walls of these waveguides is d/2, which is smaller than a cutoff distance $d_c=\lambda/2$. Electromagnetic waves do not propagate in the area B and if the size b is larger than $\lambda/4$ to $\lambda/2$, and the front-to-back ratio of the antenna array 20 is more than 25 to 35 dB. Transverse electric (TE) waves being copolarized waves are reflected from the border between the areas A and B, and transverse magnetic (TM) waves being cross-polarized waves propagate in a back direction. Therefore, the antenna array 20 has a cross-polarization level in a main beam direction less by 30 dB than the conventional antenna array shown in FIG. 1. This is especially useful for a wideband array because a wideband microstrip dipole with wide arms can have a significant cross-polarization level (see, *Phased Array Antenna Handbook,* Chapter 5.1.2).

Figure 6:
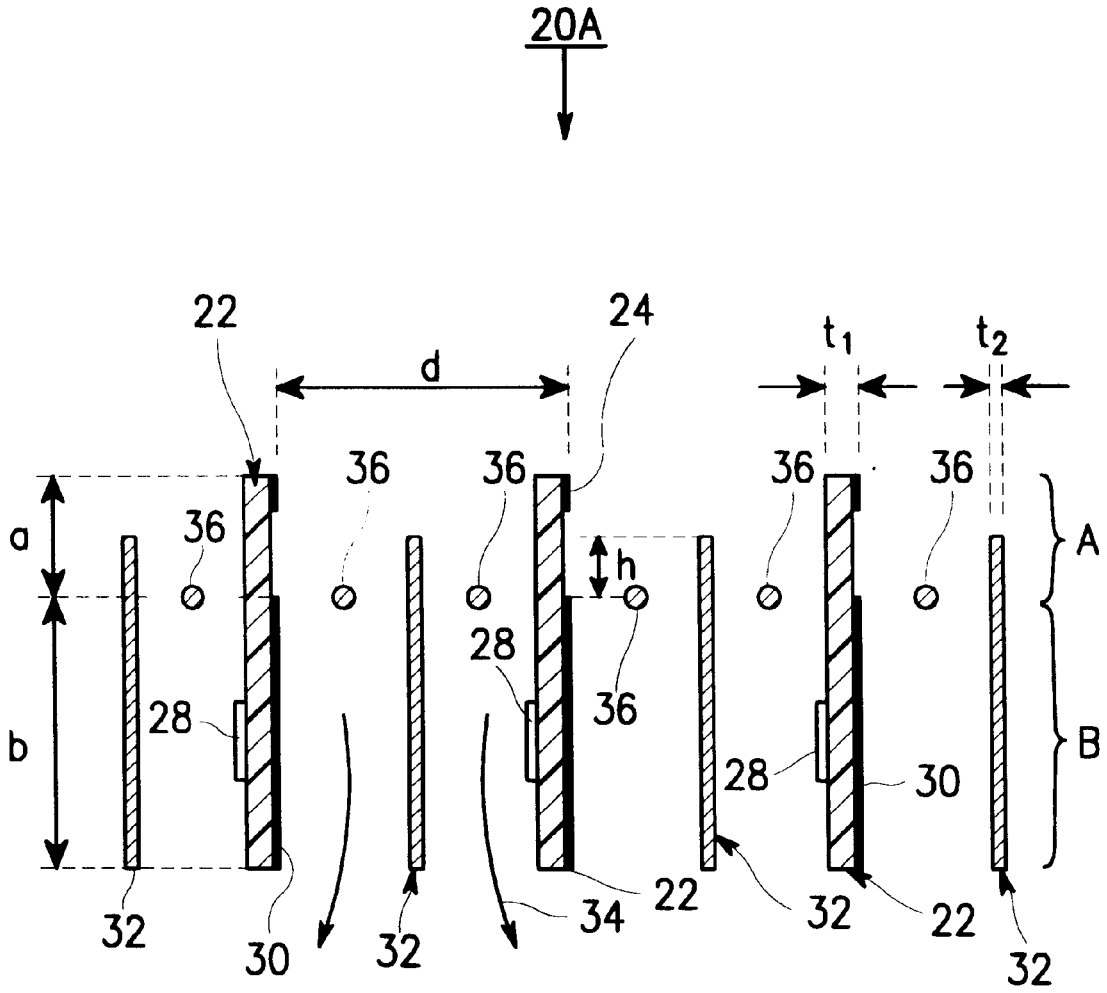
FIG. 6 is a schematic sectional view of a wideband microstrip dipole antenna according to another embodiment of the present invention.

Continuing now with reference to FIG. 6, FIG. 6 illustrates an another embodiment of a wideband microstrip dipole antenna array 20A according to the present invention, with the reference characters and the reference numeral for the elements in FIG. 6 being the same as in FIGS. 2 and 3, unless otherwise indicated. Referring to FIG. 6, in antenna array 20A, 2N slender cylindrical wires 36 acting as conductors are additionally located between the printed circuit boards (PCBs) 22 and the metal fences 32 so as to improve the front-to-back ratio of the antenna array, where the number N is the number of printed circuit boards (PCBs) 22 in antenna array 20A, N being a positive integer. The cylidrical wires 36 acting as conductors improve the front-to-back ratio by 5 to 10 dB, and give a dimension to the antenna array 20A to thereby optimize dipole parameters, that is, element pattern and matching.

Also, as an example, in accordance with the present invention, a 6×6 element prototype of a printed-dipole antenna array of the present invention without phase shifters was fabricated and tested. This printed-dipole antenna array of the present invention demonstrated a very wide operation at 1100–2000 GHz or in a 60% wideband, a high antenna efficiency of more than 50%, low sidelobes of below −20 dB, a low cross-polarization of less than −25 dB, a good front-to-back ratio of more than 25 dB, and a small wind-loaded area. As to the wind-loaded area, the wind-loaded area of this printed-dipole antenna array of the present invention was smaller by thirty (30) times than in a comparable conventional dipole antenna array.

In summary, as compared to the conventional dipole antenna array technology, a dipole antenna array according to the present invention has, for example, the following main technical advantages:

first, the wind-loaded area is reduced by 10 or more times;

second, the mutual coupling between dipoles in the H-plane is reduced by about 10 dB, thereby increasing a bandwidth and reducing sidelobes;

third, the cross-polarization is reduced by 3 dB;

fourth, the cost of the array can be reduced by 10 to 15% in view of the reduction in the number of the printed circuit boards (PCBs) due to the possible achievement of an optimal (i.e., top-flat) element pattern; and fifth, if active devices are present in the antenna array, the active devices can be more effectively cooled.

As described above, the dipole antenna array of the present invention overcomes the problems of a large wind-loaded area, a significant mutual coupling between dipoles, a poor element pattern, edge phenomenon, and poor ventilation by disposing metal fences between printed circuit boards (PCBs) with dipoles and feeds, instead of a ground screen.

While the present invention has been described in detail with reference to the specific embodiments, they are merely exemplary applications. In particular, though active devices are desirably formed on a printed circuit board (PCB) in the embodiments, it is not essential. Also, while the printed circuit boards (PCBs) and the metal fences desirably are rectangular in shape, they can also be other shapes dependent upon the application.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. A microstrip dipole antenna array, comprising:

N printed circuit boards equally spaced in parallel to one another and each having a plurality of microstrip dipoles and a microstrip feed, N being a positive integer; and N+1 metal fences, each printed circuit board being symmetrically located between and in parallel to two metal fences of said N+1 metal fences, the metal fences being arranged to provide impedance matching in a first area of the microstrip dipole antenna array and to reduce back radiation in a second area of the microstrip dipole antenna array.

2. The microstrip dipole antenna array of claim 1, further comprised of the printed circuit boards and the metal fences are each rectangular in shape.

3. The microstrip dipole antenna array of claim 2, further comprised of a size of the metal fences being equal to a size of the printed circuit boards.

4. The microstrip dipole antenna array of claim 3, further comprising an active device formed on each printed circuit board.

5. The microstrip dipole antenna array of claim 1, further comprised of a size of the metal fences being equal to a size of the printed circuit boards.

6. The microstrip dipole antenna array of claim 5, further comprising an active device formed on each printed circuit board.

7. The microstrip dipole antenna array of claim 1, further comprising an active device formed on each printed circuit board.

8. The microstrip dipole antenna array of claim 1, further comprised of the printed circuit boards and the metal fences each being of a same shape.

9. The microstrip dipole antenna array of claim 8, further comprised of a size of the metal fences being equal to a size of the printed circuit boards.

10. A microstrip dipole antenna array, comprising:

a printed circuit board having a plurality of microstrip dipoles and a microstrip feed; and a pair of metal fences, the printed circuit board being symmetrically located between and in parallel to the pair of metal fences, the metal fences being arranged to provide impedance matching in a first area of the microstrip dipole antenna array and to reduce back radiation in a second area of the microstrip dipole antenna array.

11. The microstrip dipole antenna array of claim 10, further comprised of the printed circuit board and the pair of metal fences each being rectangular in shape.

12. The microstrip dipole antenna array of claim 11, further comprised of a size of the pair of metal fences being equal to a size of the printed circuit board.

13. The microstrip dipole antenna array of claim 10, further comprising an active device formed on the printed circuit board.

14. A microstrip dipole antenna array, comprising:

N printed circuit boards equally spaced in parallel to one another and each having a plurality of microstrip dipoles and a microstrip feed, N being a positive integer;

N+1 metal fences; and 2N cylindrical conductors each as long as the printed circuit boards, each printed circuit board being symmetrically located between and in parallel to two metal fences of the N+1 metal fences, and the cylindrical conductors each being respectively disposed in parallel between the metal fences and the printed circuit boards, with a cylindrical conductor of the 2N cylindrical conductors being respectively disposed between each printed circuit board and each adjacent metal fence.

15. The microstrip dipole antenna array of claim 14, further comprised of the printed circuit boards and the metal fences each being rectangular in shape.

16. The microstrip dipole antenna array of claim 15, further comprised of a size of the metal fences being equal to a size of the printed circuit boards.

17. The microstrip dipole antenna array of claim 16, further comprising an active device formed on each printed circuit board.

18. The microstrip dipole antenna array of claim 14, further comprised of a size of the metal fences being equal to a size of the printed circuit boards.

19. The microstrip dipole antenna array of claim 18, further comprising an active device formed on each printed circuit board.

20. The microstrip dipole antenna array of claim 14, further comprising an active device formed on each printed circuit board.

21. The microstrip dipole antenna array of claim 14, further comprised of the printed circuit boards and the metal fences each being of a same shape.

22. The microstrip dipole antenna array of claim 21, further comprised of a size of the metal fences being equal to a size of the printed circuit boards.

23. The microstrip dipole antenna array of claim 22, further comprising an active device formed on each printed circuit board.

24. A microstrip dipole antenna array, comprising:

a printed circuit board having a plurality of microstrip dipoles and a microstrip feed;

a pair of metal fences; and a pair of cylindrical conductors as long as the printed circuit board, the printed circuit board being symmetrically located between and in parallel to the pair of metal fences, and the cylindrical conductors each being respectively disposed in parallel between the pair of metal fences and the printed circuit board, with a cylindrical conductor being disposed between each metal fence and the printed circuit board.

25. The microstrip dipole antenna array of claim 24 , further comprised of the printed circuit board and the pair of metal fences each being rectangular in shape.

26. The microstrip dipole antenna array of claim 25, further comprised of a size of the pair of metal fences being equal to a size of the printed circuit board.

27. The microstrip dipole antenna array of claim 26, further comprising an active device formed on the printed circuit board.

28. The microstrip dipole antenna array of claim 24 , further comprised of the printed circuit board and the pair of metal fences each being of a same shape.

29. The microstrip dipole antenna array of claim 28, further comprised of a size of each of the pair of metal fences being equal to a size of the printed circuit board.

30. The microstrip dipole antenna array of claim 29, further comprising an active device formed on the printed circuit board.

31. The microstrip dipole antenna array of claim 24, further comprising an active device formed on the printed circuit board.

32. A method for forming a microstrip dipole antenna array, comprising the steps of:

providing a printed circuit board having a plurality of microstrip dipoles and a microstrip feed;

providing a pair of metal fences, the metal fences being arranged to provide impedance matching in a first area of the microstrip dipole antenna array and to reduce back radiation in a second area of the microstrip dipole antenna array; and positioning the printed circuit board between and in parallel to the pair of metal fences.

33. The method of claim 32, further comprising the step of providing an active device on the printed circuit board.

34. A method for forming a microstrip dipole antenna array, comprising the steps of:

providing a printed circuit board having a plurality of microstrip dipoles and a microstrip feed;

providing a pair of metal fences;

positioning the printed circuit board between and in parallel to the pair of metal fences;

providing a pair of cylindrical conductors as long as the printed circuit board; and positioning the pair of cylindrical conductors in parallel respectively between the metal fences and the printed circuit board, with a cylindrical conductor being respectively positioned between each metal fence and the printed circuit board.

35. The method of claim 34, further comprising an active device formed on the printed circuit board.

36. A method for forming a microstrip dipole antenna array, comprising the steps of:

providing N printed circuit boards each having a plurality of microstrip dipoles and a microstrip feed, N being a positive integer;

positioning the N printed circuit boards in equally spaced, parallel relation to one another;

providing N+1 metal fences, the metal fences being arranged to provide impedance matching in a first area of the microstrip dipole antenna array and to reduce back radiation in a second area of the microstrip dipole antenna array; and positioning in symmetrical relation in each printed circuit board between and in parallel to two metal fences of the N+1 metal fences.

37. The method of claim 36, further comprising the step of providing an active device on each printed circuit board.

38. A method for forming a microstrip dipole antenna array, comprising the steps of:

providing N printed circuit boards each having a plurality of microstrip dipoles and a microstrip feed, N being a positive integer;

positioning the N printed circuit boards in equally spaced, parallel relation to one another;

providing N+1 metal fences;

positioning in symmetrical relation each printed circuit board between and in parallel to two metal fences of the N+1 metal fences;

providing 2N cylindrical conductors as long as the printed circuit boards; and positioning the cylindrical conductors in parallel respectively between the metal fences and the printed circuit boards, with a cylindrical conductor being respectively positioned between each printed circuit board and each adjacent metal fence.

39. The method of claim 38, further comprising the step of providing an active device on each printed circuit board.

* * * * *